US005480169A

United States Patent [19]

Wang

[11] Patent Number: 5,480,169

[45] Date of Patent: Jan. 2, 1996

[54] WHEEL AND LEG ASSEMBLY FOR A TRAVEL BAG

[76] Inventor: King-Sheng Wang, No. 569, Ching-Kuo Rd., Ta-Chia Chen, Taichung Hsien, Taiwan

[21] Appl. No.: 287,888

[22] Filed: Aug. 9, 1994

[51] Int. Cl.[6] ..... B62B 1/26

[52] U.S. Cl. ..... 280/37; 280/47.33; 16/29

[58] Field of Search ..... 280/37, 35, 47.33, 280/638, 47.18; 190/18 A; 16/29, 31 R, 40, 30

[56] References Cited

U.S. PATENT DOCUMENTS

| | | | |
|---|---|---|---|
| 1,352,234 | 9/1920 | Whitten | 280/47.33 |
| 1,561,122 | 11/1925 | Stahl | 280/35 |
| 1,744,414 | 1/1930 | Pflaum | 280/47.33 |
| 2,132,316 | 10/1938 | Newton | 280/35 |
| 2,478,563 | 8/1949 | Book | 16/30 |
| 2,650,105 | 8/1953 | Costikyan | 280/35 |
| 3,540,752 | 11/1970 | Anuskiewicz | 280/35 |
| 3,655,215 | 4/1972 | Becklin | 280/37 |
| 3,923,318 | 12/1975 | Renard et al. | 280/35 |
| 4,026,570 | 5/1977 | Feinberg | 16/29 |
| 4,463,840 | 8/1984 | Seynhaeve | 16/29 |
| 4,545,592 | 10/1985 | Taskovic | 280/35 |
| 5,335,759 | 8/1994 | Yeh | 280/37 |
| 5,426,817 | 6/1995 | Rekuc | 16/29 |

*Primary Examiner*—Margaret A. Focarino
*Assistant Examiner*—Carla Mattix
*Attorney, Agent, or Firm*—Bacon & Thomas

[57] ABSTRACT

A wheel and leg assembly fastened to one short side of a travel bag at the bottom, including a leg assembly which fits over one corner of the short side and has an oblong hole on a horizontal extension thereof, and a wheel assembly, which fits over an opposite corner of the short side and has an oblong hole on a horizontal extension of the wheel holder thereof, the oblong hole on the leg assembly being overlapped on the oblong hole on the wheel holder and connected with it to the travel bag at the bottom by a rivet.

1 Claim, 5 Drawing Sheets

WHEEL AND LEG ASSEMBLY FOR A TRAVEL BAG

BACKGROUND OF THE INVENTION

The present invention relates to a wheel and leg assembly for a travel bag, and relates more particularly to such a wheel and leg assembly which can be adjusted to fit the width of any of a variety of travel bags.

A travel bag is generally equipped with a pair of wheels and a pair of legs at the bottom so that it can be stably supported on the ground in a vertical position when it is not moved. As the corners of regular travel bags are made smoothly curved, the legs cannot be fastened around the corners. Therefore, the legs are commonly fastened to a bottom wall at the bottom of the travel bag. However, this installation may cause the travel bag to fall when heavy things are loaded in the travel bag at one side.

SUMMARY OF THE INVENTION

The present invention provides a wheel and leg assembly for a travel bag which eliminates the aforesaid problem. It is one object of the present invention to provide a wheel and leg assembly which can be fastened around two opposite corners at the bottom of a travel bag. It is another object of the present invention to provide a wheel and leg assembly which can be adjusted relative to each other to fit the width of any of a variety of travel bags.

DETAILED DESCRIPTION OF THE PREFERRED EMBODIMENT

Figure 1:
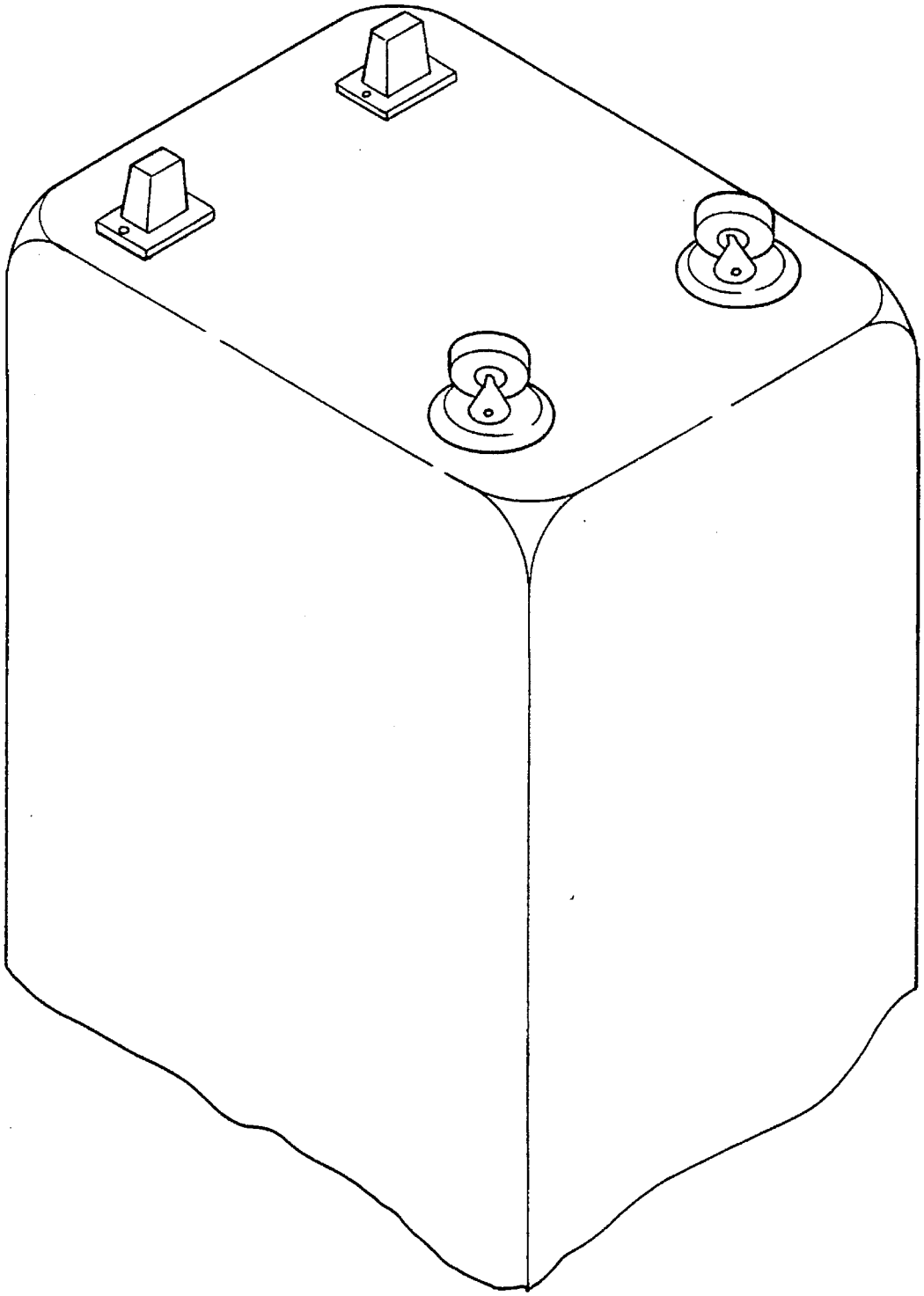
Fig.1 PRIOR ART
FIG. 1 is a perspective view showing the arrangement of wheels and legs on the bottom of a travel bag according to the prior art.
Figure 2:
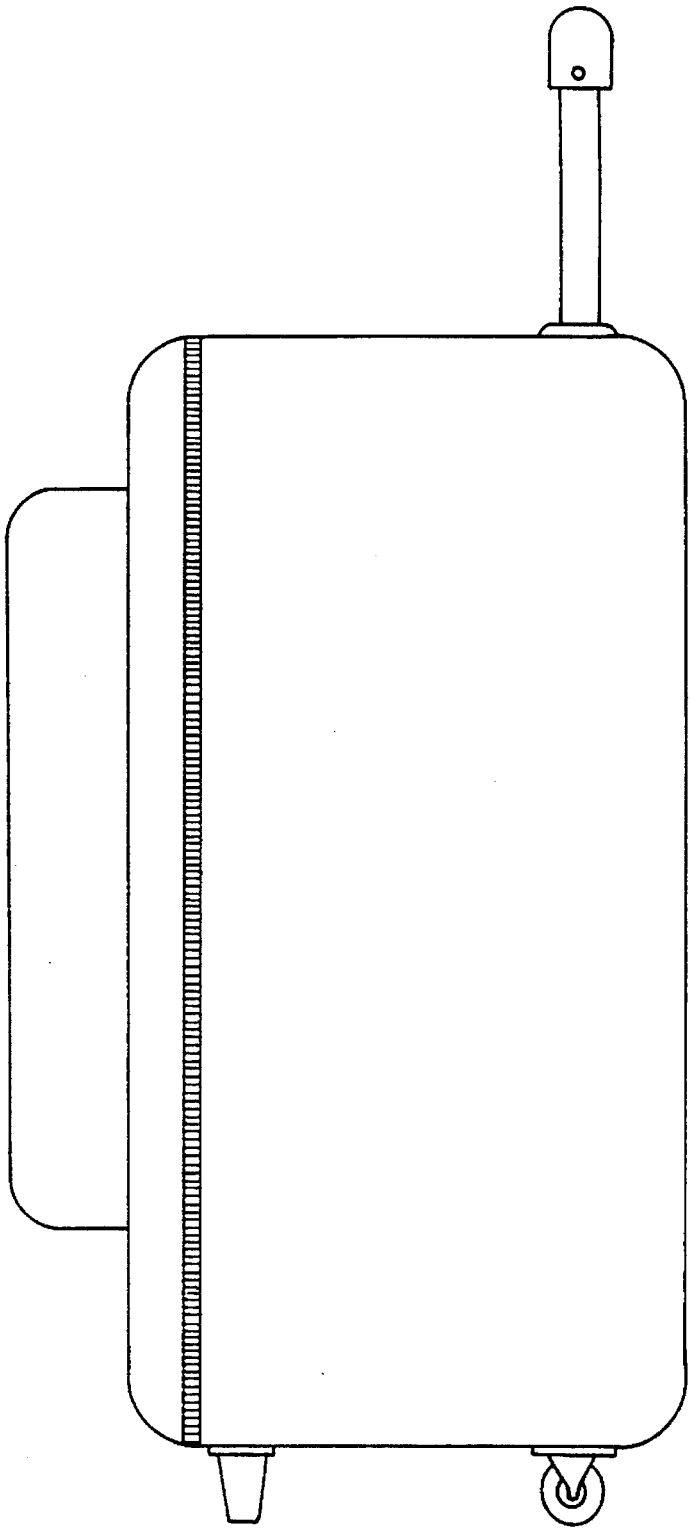
Fig.2 PRIOR ART
FIG. 2 is a side view of the travel bag shown in FIG. 1.
Figure 3:
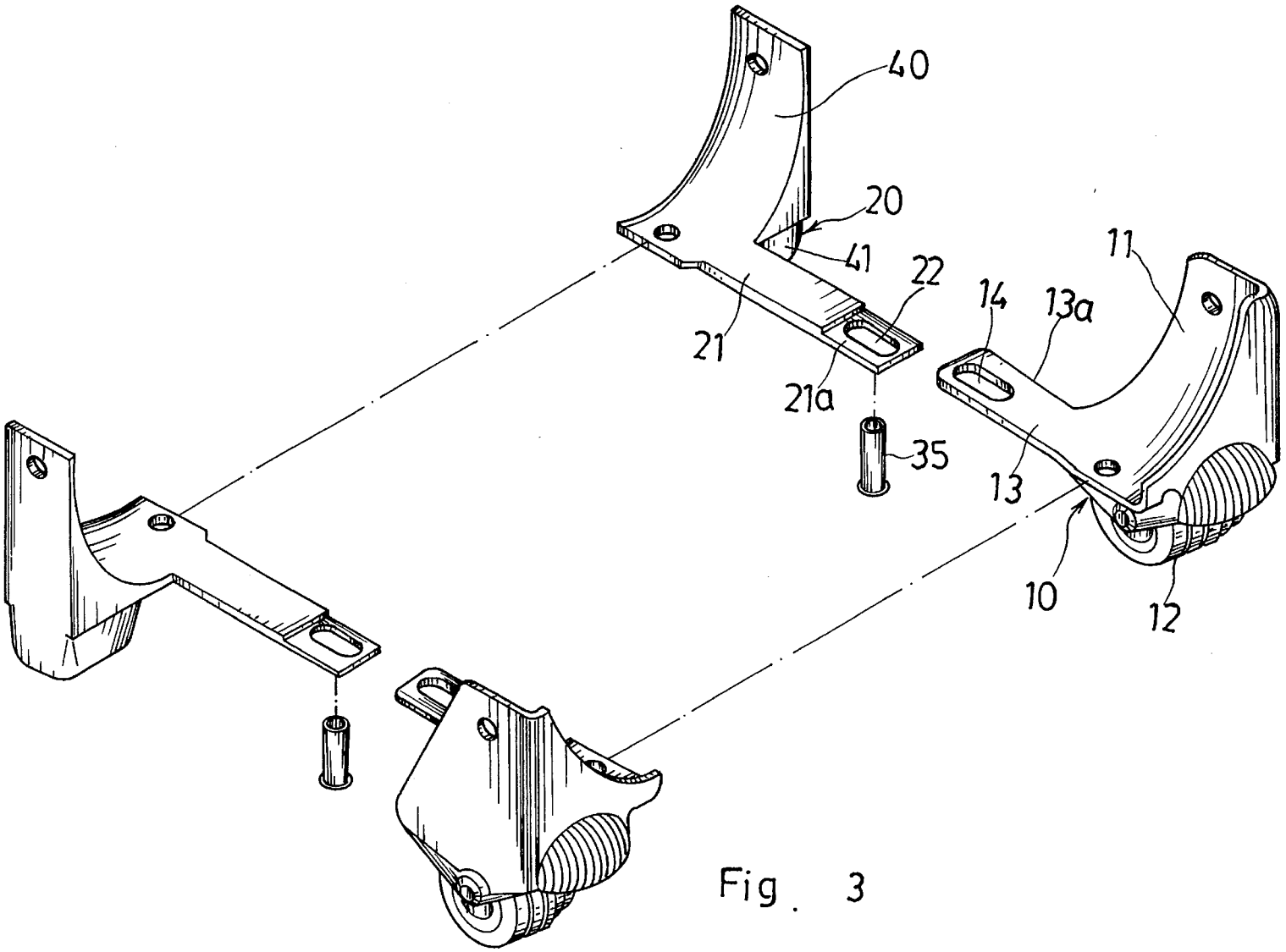
FIG. 3 is an exploded view of a pair of wheel and leg assemblies for a travel bag according to the present invention.
Figure 4:
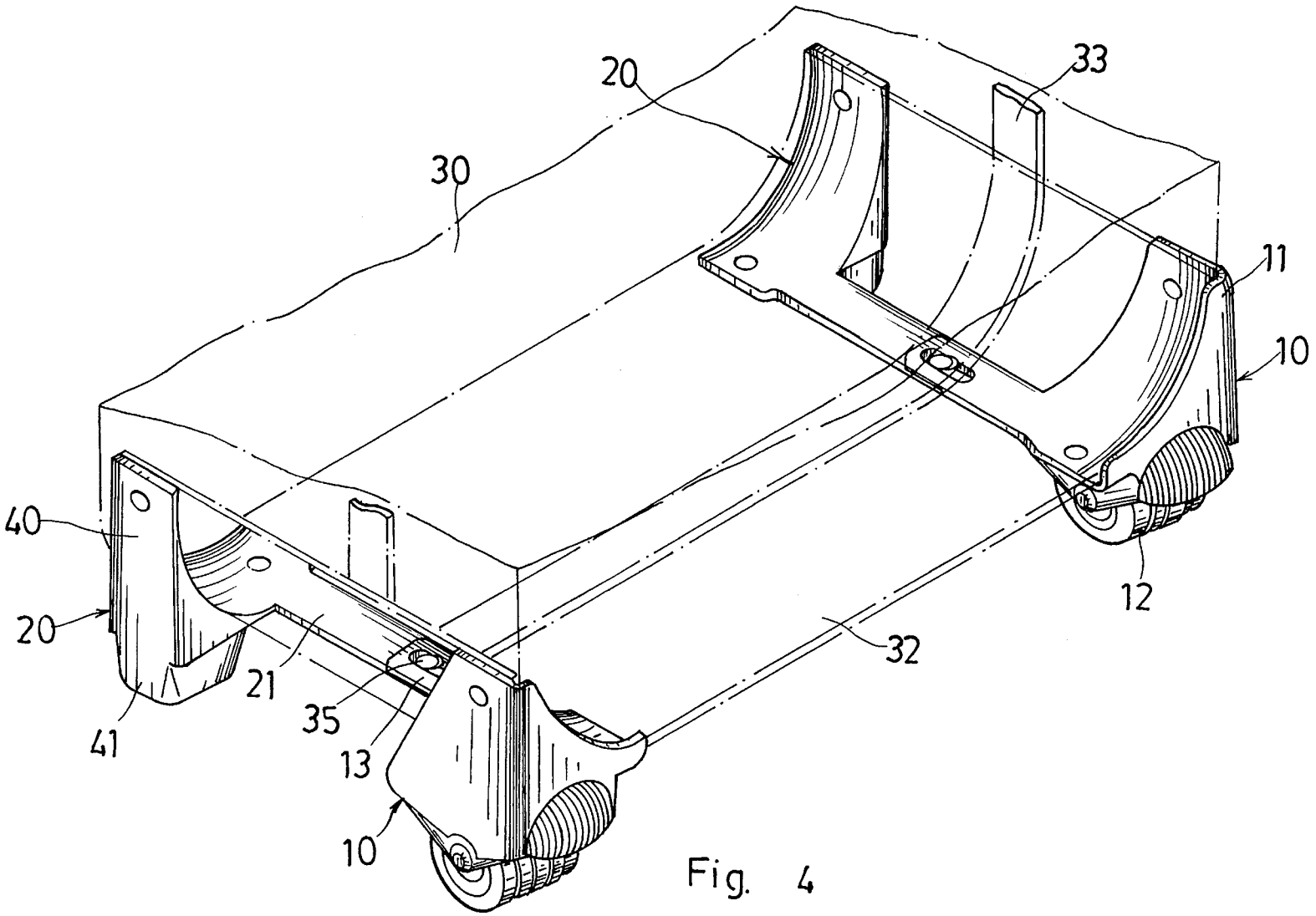
FIG. 4 is an assembly view showing the wheel and leg assemblies of FIG. 3 installed on a travel bag.
Figure 5:
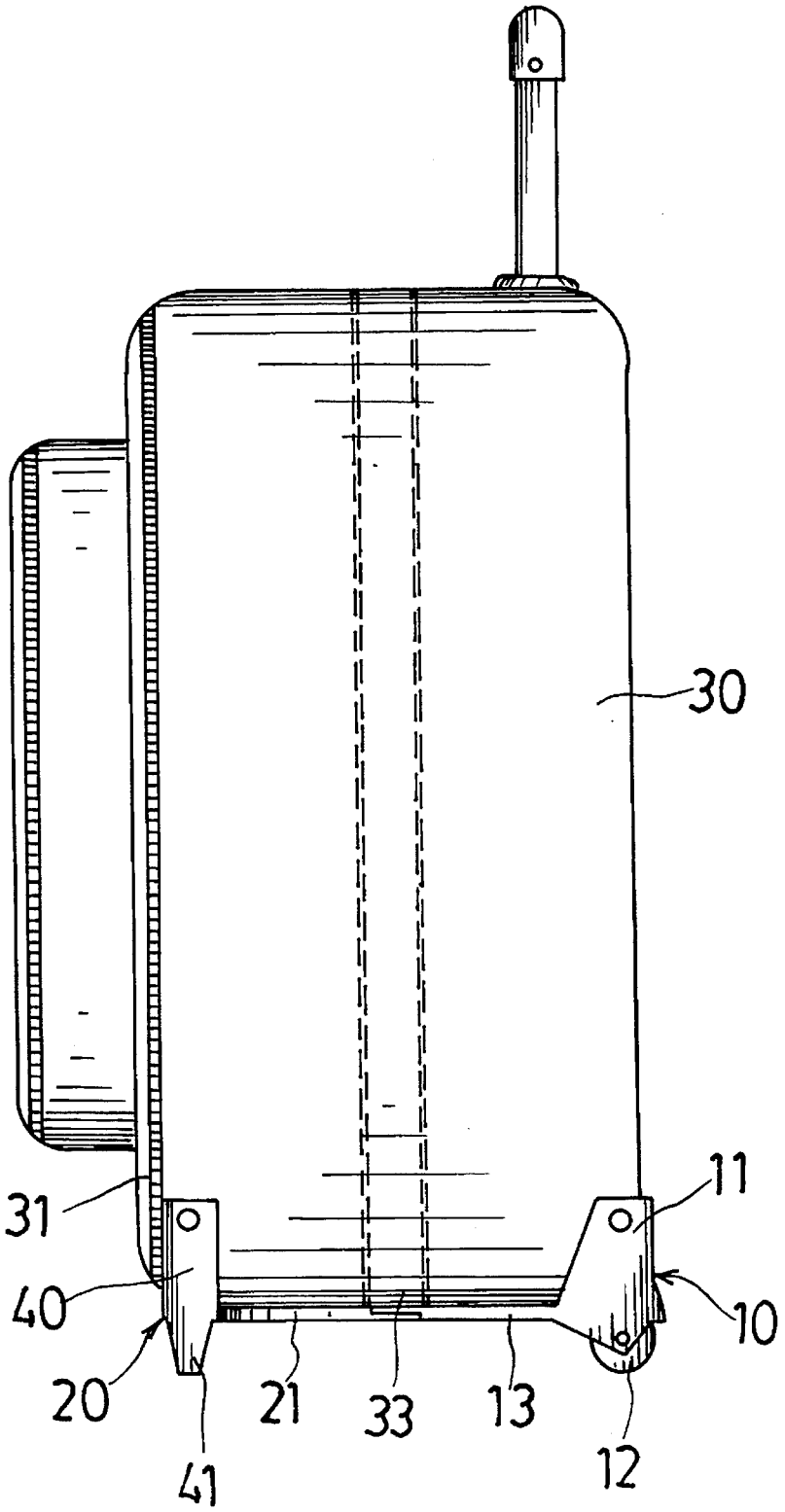
FIG. 5 is a side view of the travel bag shown in FIG. 4.

Referring to FIGS. 3, 4, and 5, two wheel and leg assemblies are bilaterally mounted on two opposite short sides of a travel bag 30 at the bottom thereof. The wheel and leg assembly 10 is generally comprised of a separate leg assembly 20 and a separate wheel assembly 10 which is linked to leg assembly 20. The wheel assembly 10 is comprised of a wheel holder 11 and a wheel 12. The wheel holder 11 is configured to fit over one corner of the travel bag, generally referred to at 30. The leg assembly 20 includes a leg holder 40 and a leg 41. The leg holder 40 is configured to fit over an opposite corner of the travel bag 30 adjacent to and spaced from the zip fastener 31. The leg holder 40 comprises a horizontal extension 21 at an inner side thereof and an oblong hole 22 on a mounting lug 21*a* at the terminal end of the horizontal extension 21. The wheel holder 11 comprises a horizontal extension 13 at an inner side thereof and an oblong hole 14 on a mounting lug 13*a* at the terminal end of the horizontal extension 13. When the wheel assembly 10 and the leg assembly 20 are attached to two opposite corners of the travel bag 30 at the bottom along one short side of the travel bag 30, the oblong holes 14 and 22 are overlapped and then fastened to the bottom lining plate 32 and follower plate 33 of the travel bag 30 by a rivet 35. A corresponding wheel assembly 10 and a corresponding leg assembly 20 are attached to two opposite corners along the other short side of bag 30.

The arrangement of the aforesaid oblong holes 14 and 22 permits the wheel assembly 10 and the leg assembly 20 to be adjusted relative to each other to fit the width of the travel bag. Therefore, the present invention is suitable for travel bags of different sizes.

I claim:

1. A wheel and leg assembly for a travel bag having a rectangular bottom, the assembly comprising:

a) a wheel assembly including a wheel holder configured to fit over a first bottom corner of a travel bag, a wheel, a horizontal extension at an inner side of the wheel holder, the horizontal extension terminating in a mounting lug, and an oblong hole formed in the mounting lug;

b) a leg assembly including a leg holder configured to fit over a second bottom corner of the travel bag, a leg, a horizontal extension at an inner side of the leg holder, the horizontal extension terminating in a mounting lug, and an oblong hole formed in the mounting lug; and c) wherein when the wheel assembly and the leg assembly are engaged against opposite bottom corners along a short side of the bag bottom, the mounting lugs and oblong holes of the wheel and leg assemblies overlap for permitting adjustment of the wheel and leg assembly to the length of the short side and receiving a rivet through the oblong holes to secure the wheel and leg assembly to the bottom of the bag.

* * * * *